US008554118B2

(12) United States Patent
Sato

(10) Patent No.: US 8,554,118 B2
(45) Date of Patent: Oct. 8, 2013

(54) DEVELOPER UNIT FOR AN IMAGE FORMING APPARATUS

(75) Inventor: Shougo Sato, Aichi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 317 days.

(21) Appl. No.: 12/957,368

(22) Filed: Nov. 30, 2010

(65) Prior Publication Data

US 2011/0129261 A1 Jun. 2, 2011

(30) Foreign Application Priority Data

Nov. 30, 2009 (JP) ..... 2009-271828

(51) Int. Cl.
*G03G 15/08* (2006.01)

(52) U.S. Cl.
USPC ..... 399/263

(58) Field of Classification Search
USPC ..... 399/256, 258, 262, 263
See application file for complete search history.

(56) References Cited

U.S. PATENT DOCUMENTS

| | | | | |
|---|---|---|---|---|
| 5,419,468 | A | 5/1995 | Taki | |
| 5,581,334 | A * | 12/1996 | Forlani et al. | 399/263 |
| 5,655,193 | A | 8/1997 | Fujishiro et al. | |
| 7,881,633 | B2 * | 2/2011 | Sakuma | 399/106 |
| 8,005,397 | B2 | 8/2011 | Sato | |
| 2006/0008297 | A1 | 1/2006 | Oyama et al. | |
| 2008/0145105 | A1 * | 6/2008 | Iwamura | 399/254 |
| 2009/0142116 | A1 | 6/2009 | Sato et al. | |
| 2009/0169245 | A1 | 7/2009 | Sato | |
| 2011/0286772 | A1 | 11/2011 | Sato | |

FOREIGN PATENT DOCUMENTS

| | | | |
|---|---|---|---|
| CN | 101571694 | A | 11/2009 |
| JP | H06-035322 | A | 2/1994 |
| JP | H08-146765 | A | 6/1996 |
| JP | H10-333409 | A | 12/1998 |
| JP | 2006-030276 | A | 2/2006 |
| JP | 2007-304453 | A | 11/2007 |
| JP | 2009-009119 | A | 1/2009 |
| JP | 2009-139490 | A | 6/2009 |
| JP | 2009-251337 | A | 10/2009 |

OTHER PUBLICATIONS

State Intellectual Property Office of the People's Republic of China, The Second Office Action for Chinese Patent Application No. 201010583456.7 (counterpart Chinese patent application), mailed Dec. 12, 2012.

(Continued)

*Primary Examiner* — David Gray
*Assistant Examiner* — Gregory H Curran
(74) *Attorney, Agent, or Firm* — Baker Botts L.L.P.

(57) ABSTRACT

A developer unit for an image forming apparatus is provided. The image forming apparatus includes a developer device having a developer agent carrier and a developer agent supplier, a developer agent container arranged in an upper position with respect to the developer device, and a curved wall, which separates the developer device from the developer agent container; is curved toward the developer agent container; and is formed to have a feeding opening and a collecting opening, and a conveyer, which is arranged along the developer agent supplier and conveys the developer agent toward the collecting opening. The curved wall is arranged to be in proximity to the conveyer and to fit with outlines of the conveyer.

12 Claims, 9 Drawing Sheets

(56) References Cited

OTHER PUBLICATIONS

State Intellectual Property Office of the People's Republic of China, The First Office Action for Chinese Patent Application No. 201010583456.7 (counterpart to above-captioned patent application), mailed Apr. 1, 2012.

State Intellectual Property Office of the People's Republic of China, Notification of the Third Office Action for Chinese Patent Application No. 201010583456.7 (counterpart to above-captioned patent application), mailed Jun. 13, 2013.

* cited by examiner

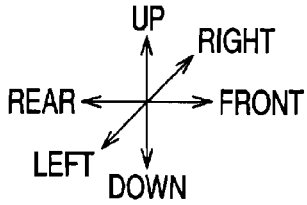
FIG. 7
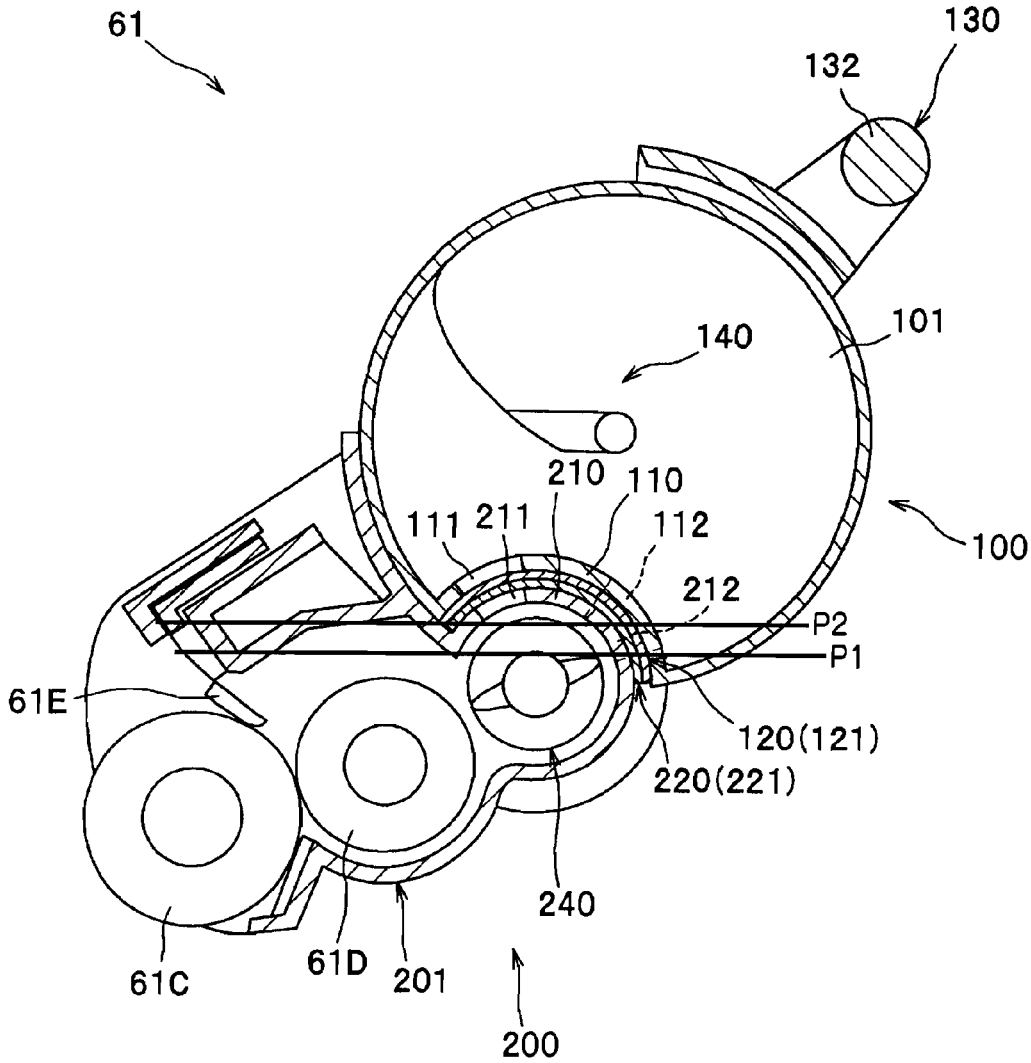

DEVELOPER UNIT FOR AN IMAGE FORMING APPARATUS

CROSS REFERENCE TO RELATED APPLICATION

This application claims priority from Japanese Patent Application No. 2009-271828, filed on Nov. 30, 2009, the entire subject matter of which is incorporated herein by reference.

BACKGROUND

1. Technical Field

An aspect of the present invention relates to a developer unit for an image forming apparatus.

2. Related Art

An image forming apparatus for forming an image on a recording medium with a developer unit has been known. The developer unit is often provided with a developer device with a developer roller to carry a developer agent on a surface thereof, a supplier roller to supply the developer agent to the developer roller, and a spreader blade to spread the developer agent evenly on the surface of the developer roller. The developer unit may further be provided with a developer agent container to contain the developer agent to be supplied to the developer device. In order to supply the developer agent in homogenized condition so that consistent image-forming quality is maintained, the developer unit may be designed to have the developer agent to be circulated between the developer device and the developer agent container. In such a developer unit, the developer agent container may be arranged in a higher position with respect to the developer device.

SUMMARY

In the developer unit with the developer agent container arranged in the upper position with respect to the developer device, the developer agent in the developer agent container easily drop down in the developer device by effect of gravity; therefore, pressure of the developer agent in the developer agent container tends to increase easily. The increased pressure may cause troubles in the developer device. For example, the developer roller and the supplier roller may be damaged by the excessively increased pressure. For another example, the developer agent may leak from clearance between the developer roller and the spreader blade. Further, an obstacle may intervene in the clearance.

In view of the above deficiencies, the present invention is advantageous in that a developer unit, in which pressure increase of the developer agent in the developer device is prevented, is provided.

According to an aspect of the present invention, a developer unit for an image forming apparatus to form an image on a recording sheet is provided. The developer unit includes a developer device having a developer agent carrier, which carries a developer agent on a surface thereof, and a developer agent supplier, which supplies the developer agent to the developer agent carrier, a developer agent container, which contains the developer agent to be supplied to the developer device and is arranged in an upper position with respect to the developer device, and a curved wall, which separates the developer device from the developer agent container; is curved toward the developer agent container; and is formed to have a feeding opening, through which the developer agent from the developer agent container is supplied to the developer device, and a collecting opening, through which the developer agent in the developer device is retrieved in the developer agent container, and a conveyer, which is arranged along the developer agent supplier and rotated about a rotation axis to convey the developer agent supplied to the developer device through the feeding opening toward the collecting opening. The curved wall is arranged to be in proximity to the conveyer and to fit with outlines of the conveyer.

BRIEF DESCRIPTION OF THE ACCOMPANYING DRAWINGS

FIG. 7 is a cross-sectional side view of the developer unit with the first and second shutters in the closing positions.

DETAILED DESCRIPTION

Hereinafter, an embodiment of the present invention will be described with reference to the accompanying drawings. A color multifunction peripheral device (hereinafter, MFP) 1 represents an image processing device having a developer unit 61 according to the present invention.

Overall Configuration of the MFP

Figure 1:
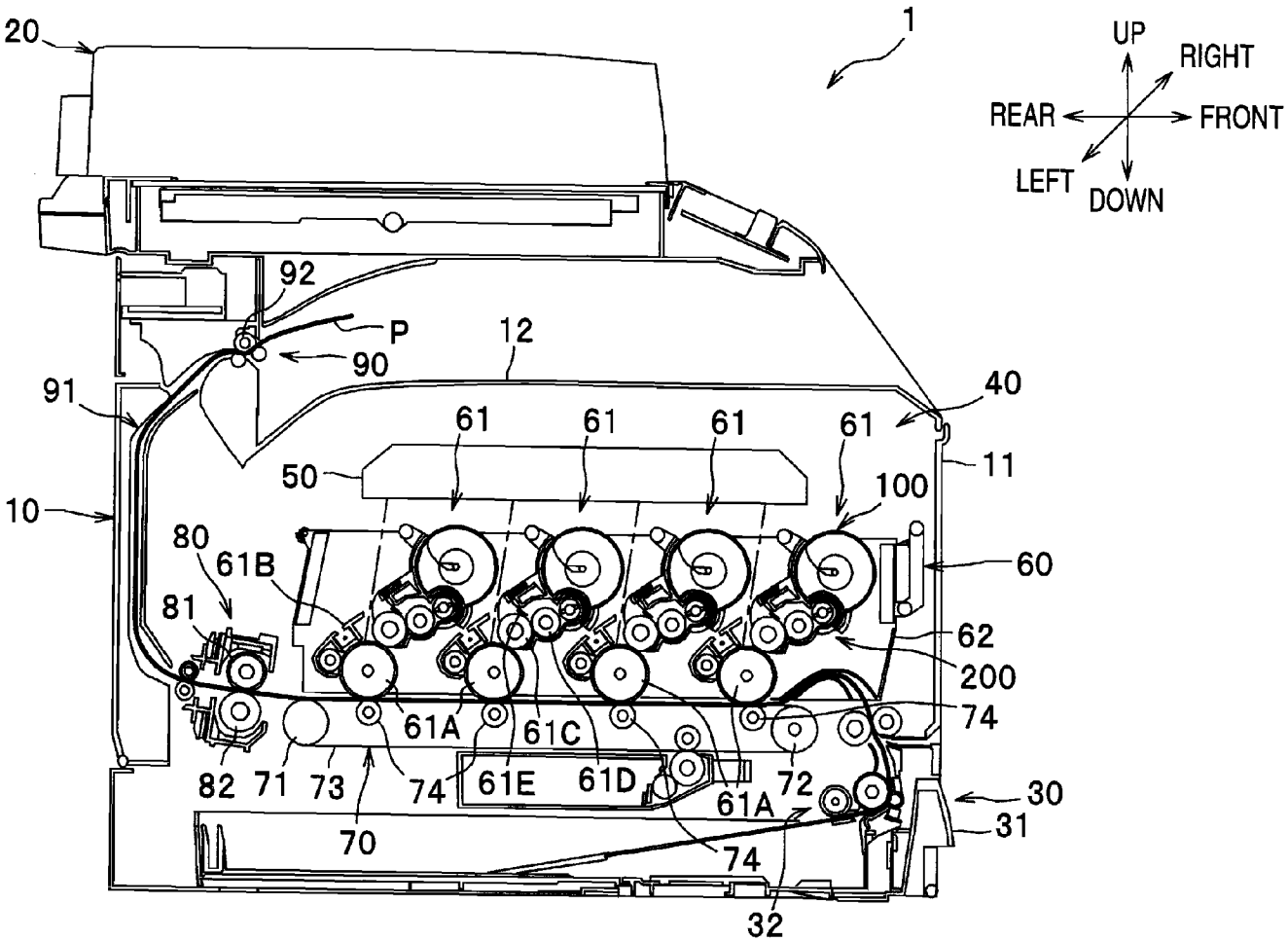
FIG. 1 is a schematic cross-sectional view of a multifunction peripheral device (MFP) having developer units according to an embodiment of the present invention.

As shown in FIG. 1, the MFP 1 is equipped with a chassis 10 and a flatbed scanner 20. In the chassis 10, the MFP 1 is provided with a sheet-feed unit 30, which feeds recording sheet P in a feeding path, an image forming unit 40, which forms an image on the sheet P being fed, and a discharge unit 90, which ejects the sheet P with the image formed thereon.

In the present embodiment, directions concerning the MFP 1 will be referred to in accordance with orientation of the MFP 1 shown in FIG. 1. That is, a viewer's right-hand side appearing in FIG. 1 is referred to as a front side of the MFP, and a left-hand side, which is opposite side from the front side, is referred to as rear. Further, a viewer's nearer side is referred to as left, and a further side is referred to as right.

Figure 2:
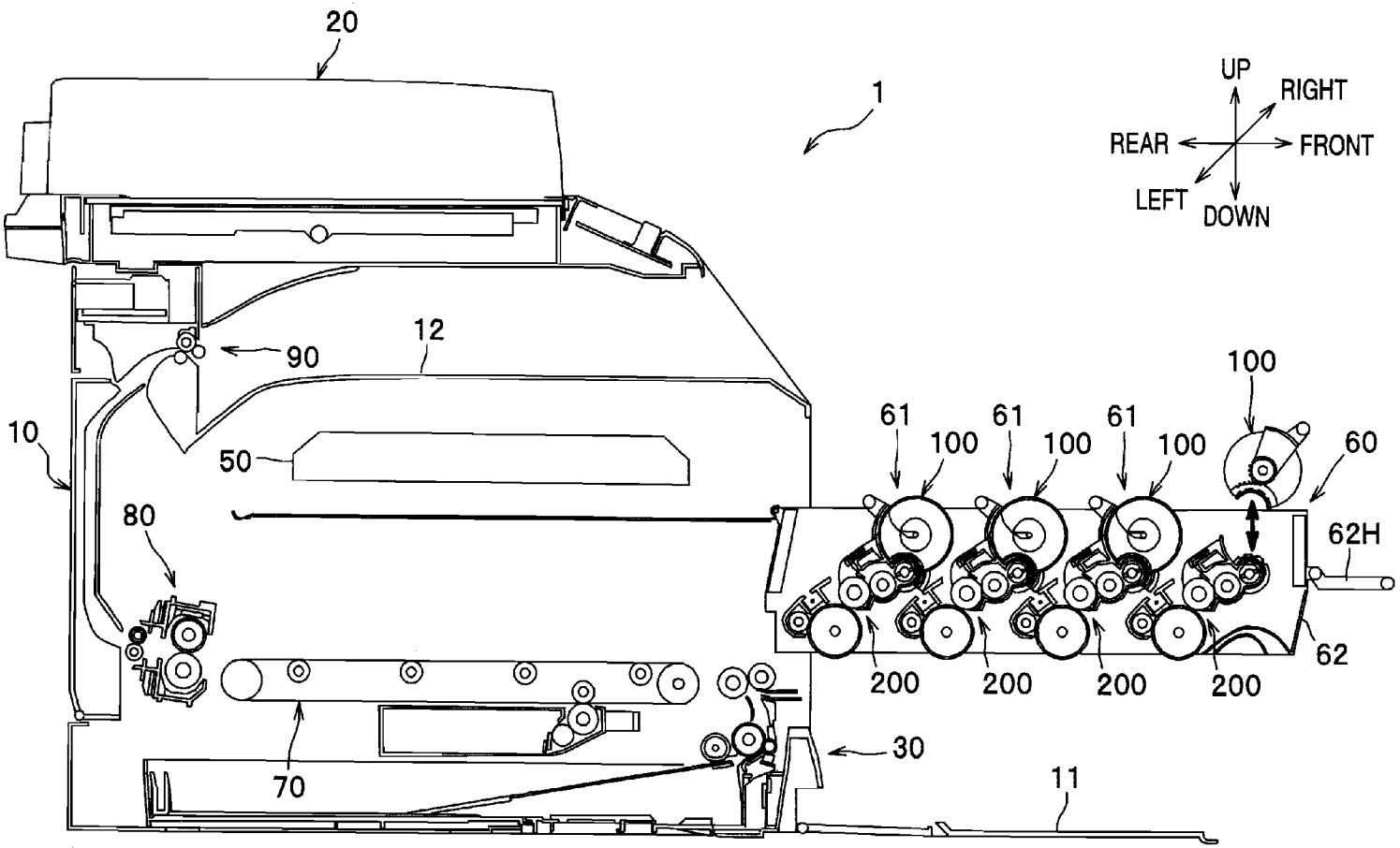
FIG. 2 is a schematic view of the MFP and the developer units according to the embodiment of the present invention with a holder case removed out of a chassis.

Furthermore, vertical (up-down) direction of the MFP 1 corresponds to an up-down direction appearing in FIG. 1. Directions of the drawings in FIG. 2 are similarly based on the orientation of the MFP 1 as defined above and correspond to those with respect to the MFP 1 shown in FIG. 1. In FIGS. 3-7, directions of the drawings are as indicated by arrows.

The flat bed scanner 20 is a known document reader, which is arranged on top of the chassis 10. The flatbed scanner 20 irradiates light onto a source document to read an image formed thereon and creates image data representing the read image. Thus, the image on the source document can be copied.

The sheet-feed unit 30 is arrange in a lower section of the chassis 10. The sheet-feed unit 30 includes a sheet-feed tray 31, in which the sheets P are stored, and a sheet-feeder 32, which conveys the sheets P one-by-one from the sheet-feed tray 31 to the image forming unit 40.

The image forming unit 40 includes an exposure section 50, a processing section 60, a transfer section 70, and a fixing section 80.

The exposure section 50 is arranged in an upper section in the chassis 10 and includes a laser-beam source, a polygon mirror, a lens, and a reflection mirror, which are not shown. A laser beam emitted from the laser-beam source is reflected on the polygon mirror and the reflection mirror and transmits through the lens to be casted to scan on surfaces of photosensitive drums 61A.

The processing section 60 is arranged between the sheet-feed unit 30 and the exposure section 50 and includes four developer units 61, which are aligned in line along a front-rear direction, and a holder case 62 to hold the developer units 61.

Each of the developer units 61 includes a toner box 100 and a developer device 200. The toner box contains toner being a developer agent therein. Each toner in the toner box 100 is in a different color, and in the present embodiment, a colored image is formed in the four colored toners. The developer device 200 includes a photosensitive drum 61A, a charger 61B, a developer roller 61C to carry the toner, a supplier roller 61D, and a spreader blade 61E (see also FIG. 3). The developer unit 61 including the toner box 100 and the developer device 200 will be described later in detail.

The holder case 62 can be installed in the chassis 10 through an opening, which can be covered with a front cover 11. The holder case 62 has a handle 62H, and when the front cover 11 is open (see FIG. 2), the holder case 62 can be withdrawn out of the chassis 10 by the handle 62H. When the holder case 62 is outside the chassis 10, the toner boxes 100 can be removed from the chassis 10 and replaced with new toner boxes 100. The developer devices 200 may be either detachable from the holder case 62 or fixed to the holder case 62.

The transfer section 70 is arranged between the sheet-feed unit 30 and the processing section 60. The transfer section 70 includes a driving roller 71, a driven roller 72, and an endless conveyer belt 73, which is extended to roll around the driving roller 71 and the driven roller 72, and four transfer rollers 74. The conveyer belt 73 is arranged to have its upper and outer surface to be in contact with the photosensitive drums 61A. The transfer rollers 74 are arranged in positions to be in contact with an upper-inner surface of the conveyer belt 73 to nip the conveyer belt 73 with the photosensitive drums 61A.

The fixing section 81 is arranged in a position closer to the rear of the MFP 1 and includes a heat roller 81 and a pressure roller 82. The pressure roller 82 is arranged in a position opposite from the heat roller 81 and presses the sheet P against the heat roller 81.

In the image forming unit 40, the charger 61B charges the surface of the photosensitive drum 61A evenly, and the surface of the photosensitive drum 61A is exposed to the laser beam emitted based on the image data from the exposure section 50 in order to form an electrostatic latent image thereon. Meanwhile, the toner in the toner box 100 is supplied to the developer roller 61C via the supplier roller 61D and spread evenly in a layer of a predetermined thickness between the spreader blade 61E and the developer roller 61C Thsu, the toner is carried in a layer by the developer roller 61C.

When the toner on the developer roller 61C comes in contact with the photosensitive drum 61A, the toner is supplied to the surface of regions corresponding to the electrostatic latent image formed on the photosensitive drum 61A. Accordingly, the electrostatic latent image is developed to be a toner image on the photosensitive drum 61A. As the photosensitive drum 61A is rotated further, and when the sheet P conveyed on the conveyer belt 73 comes to a position opposite from the photosensitive drum 61A and the transfer roller 74, the toner image on the photosensitive drum 61A is transferred to the sheet P. Thus, an image in a color of the toner is formed on the sheet P. As the sheet P is continuously conveyed in the image forming unit 40, images in the different colors corresponding to the other toners are sequentially formed on the sheet P so that the colored image is completed. The sheet P is further conveyed in the fixing section 80 between the heat roller 81 and the pressure roller 82, and the colored image is thermally fixed on the sheet P.

The discharge unit 90 includes a discharge guide 91, which is formed to direct the sheet P from the fixing unit 80 toward upward-front of the MFP 1, and a discharge roller 92 to eject the sheet P out of the discharge unit 90. The sheet P with the thermally-fixed toner image is carried along the discharge guide 91 and directed to a discharge tray 12, which is formed in an upper section of the chassis 10.

Configuration of the Developer Unit

The developer unit 61 including the toner box 100 and the developer device 200 will be described in detail hereinbelow.

Figure 3:
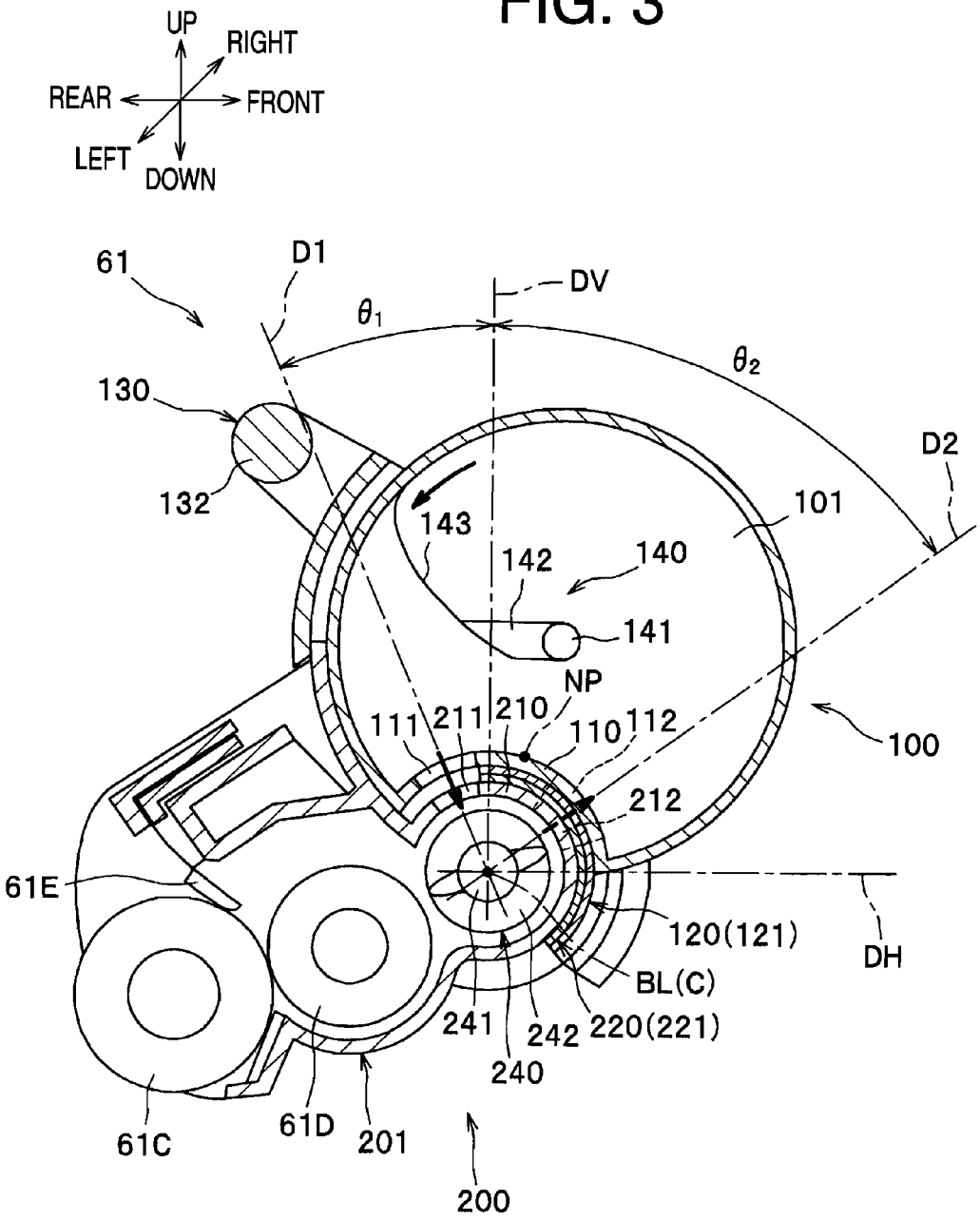
FIG. 3 is a cross-sectional side view of the developer unit according to the embodiment of the present invention with first and second shutters in opening positions.

Firstly, the toner box 100 will be described. The toner box 100 is installed in the developer unit 61 in an upper and adjoining position with respect to the developer device 200 (see also FIG. 2) to be detachably attached to the developer device 200. The toner box 100 is formed to have a shape of a partially-dented cylinder with left and right side walls 101. In particular, a circumferential surface of the cylinder is formed to have a fitting wall 110 in a position to be adjacent to the developer device 200 when the toner box 100 is attached to the developer device 200. The fitting wall 110 is curved inward in an arc to fit with an outer peripheral surface of the adjoining developer device 200. The fitting wall 110 is dented, in a cross-sectional view (see FIG. 3), to center around a reference line BL, which extends in parallel with a rotation shaft 241 of an auger 240 in the developer device 200. In particular, whilst the rotation shaft 241 extends laterally in the right-left direction (i.e., in the depth direction in FIG. 3) in the MFP 1, the reference line BL is included inside a rotation trajectory of spirals 242, 243 of the auger 240. More specifically, the reference line BL coincides with a rotation axis C of the auger 240, as shown in FIG. 3, when the auger 240 is viewed from a side. Description of the auger 240 will be given later in detail.

In other words, the fitting wall 110 is formed to fit with a part of an outer surface of the developer device 200. In particular, the fitting wall 110 partially surrounds the auger 240, which has a cross-sectional shape of a circle, via a half-pipe wall 210 of the developer device 200. The fitting wall 110 is arranged in a position adjacent to the auger 240 via the half-pipe wall 210 whilst a small amount of clearance, which allows the toner to flow therein, is reserved between the auger 240 and an inner surface of the half-pipe wall 210.

The fitting wall 110 is formed to have a first feeding hole 111 and two first collecting holes 112. The first feeding hole 111 is an opening, through which the toner stored in the toner box 100 is supplied to the developer device 200. A flow of supplying the toner through the first feeding hole 111 is indicated by a thick solid downward arrow in FIG. 3. The first collecting holes 112 are openings, through which the toner in the developer device 200 is retrieved to be stored in the toner box 100. A flow of collecting the toner through the first collecting holes 112 is indicated by a thick broken arrow in FIG. 3.

Figure 4A:
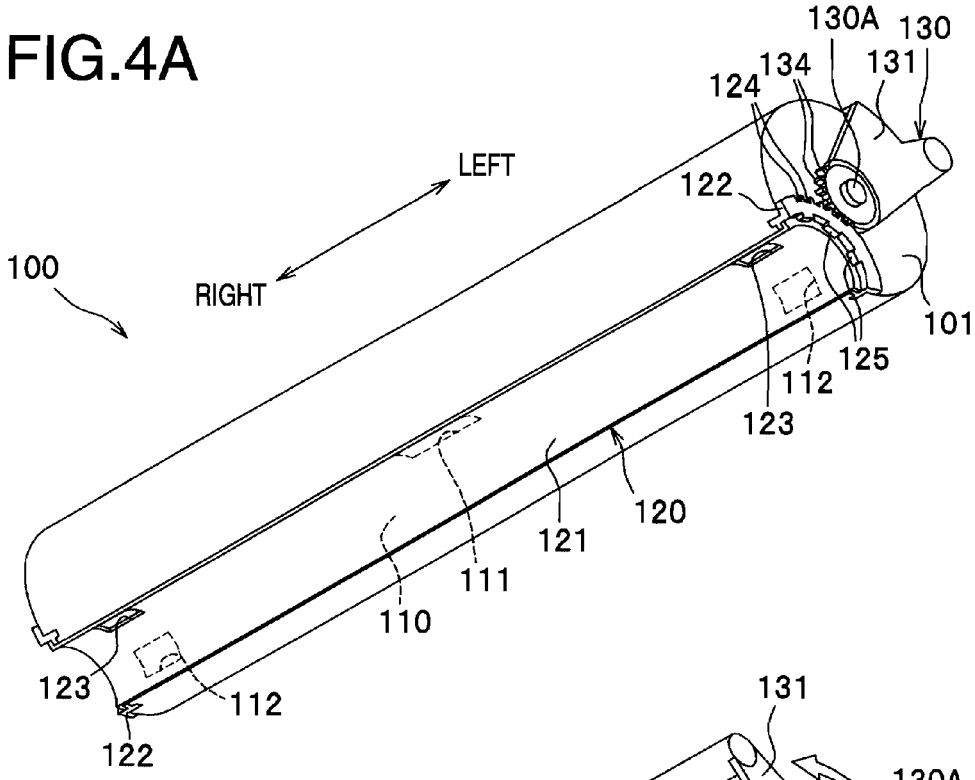
FIG. 4A is a perspective view of a toner box of the developer unit according to the embodiment of the present invention with the first shutter in a closing position.
Figure 4B:
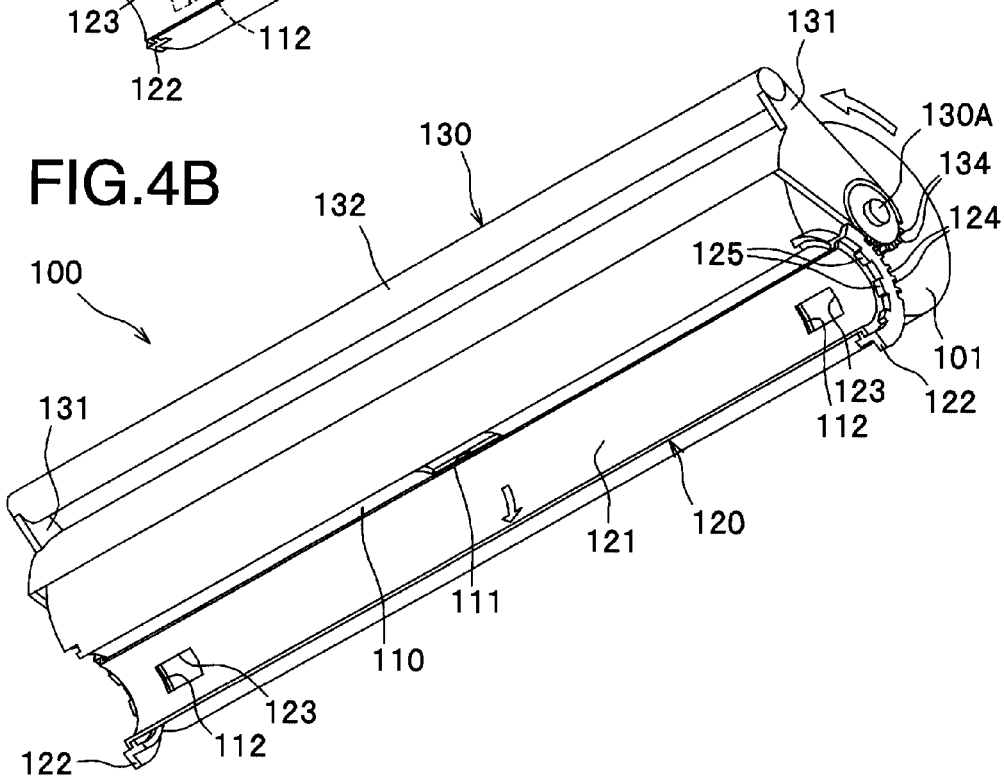
FIG. 4B is a perspective view of the toner box of the developer unit according to the embodiment of the present invention with the first shutter in the opening position.

The first feeding hole 111 and the first collecting holes 112 are formed in laterally (in the right-left direction) displaced positions. The right-left direction in the present embodiment corresponds to the direction of the rotation shaft 240 of the auger 240. As shown in FIGS. 4A and 4B, the first feeding hole 111 is formed in the fitting wall 110 in a central area with respect to the right-left direction and in an upper position in the central area. Each first collecting hole 112 is formed in vicinity of either a left or a right side end of the fitting wall 110 and in a lower position.

Further, as shown in the cross-sectional view in FIG. 3, the first feeding hole 111 is formed in the fitting wall 110 in an upper-stream position in a rotating direction of an agitator 140 with respect to a nearest point NP, which is in a shortest distance from a rotation axis 141 of the agitator 140. Meanwhile, the first collecting holes 112 are formed in lower-stream positions in the rotating direction of the agitator 140 with respect to the nearest point NP. The agitator 140 will be described later in detail.

According to the present embodiment, an angle $\theta_2$ between a direction D2, along which the first collecting holes 112 are oriented, and a vertical (up-down) direction DV, is larger than an angle $\theta_1$ between a direction D1, along which the first feeding hole 111 is oriented, and the vertical direction DV. Therefore, inclination of the direction D2, which corresponds to the orientation of the first collecting holes 112, is closer to a horizontal line DH than inclination of the direction D1, which corresponds to the orientation of the first feeding hole 111. Further, the inclination of the direction D1 is closer to the vertical direction DV than the inclination of the direction D2.

The toner box 100 includes a first shutter 120 (see FIGS. 3, 4A, and 4B), which is slidable along the curvature of the fitting wall 110, to cover and expose the first feeding hole 111 and the first collecting holes 112. The first shutter 120 includes a metal plate 121, which is formed to curve along the fitting wall 110, and a pair of slider pieces 122, which are attached to right and left side edges of the metal plate 121.

The metal plate 121 is formed to have two openings 123. Each opening 123 is formed in the vicinity of the right and left side edges of the first shutter 120. When the first shutter 120 is in a closing position (i.e., a front position as shown in FIG. 4A), the first feeding hole 111 and the first collecting holes 112 are covered with the metal plate 121. When the first shutter 120 is shifted in an opening position (i.e., a rear position as shown in FIG. 4B), the first feeding hole 111 is uncovered, and the openings 123 coincide with the first collecting holes 112. Accordingly, the first collecting holes 112 and the first feeding hole 111 are exposed.

The slider pieces 122, respectively arranged on the right and left side edges of the metal plate 121, are supported by right and left side ends of the fitting wall 110 and slidable with respect to and along the curvature of the fitting wall 110. Each slider piece 122 is formed to have a plurality of dents 124 on its outer circumferential edge. Further, the slider piece 122 is formed to have a plurality of teeth 125 on its inner circumferential edge (see also FIGS. 8A, 8B).

The toner box 100 further includes a shutter handler 130, which can manipulate the first shutter 120 and a second shutter 220. The shutter handler 130 includes a pair of supporting parts 131 and a handle 132. The supporting parts 131 are attached to the side walls 101 by a rotation shaft 130A and rotatable about the rotation shaft 130A. The handle 132 is a bar extending in parallel with the rotation shaft 130A and connects the left and right supporting parts 131.

The supporting part 131 is formed to have a plurality of teeth 134, which partially surround the rotation shaft 130A, on a side across the rotation shaft 130A from the handle 132. The teeth 134 can be interlocked with the dents 124 in the slider piece 122 so that the first shutter 120 is shifted along the circumference of the fitting wall 110 in cooperation with rotating movement of the supporting parts 131, which are rotated according to a user's manipulation to the handle 132 (see FIGS. 8A, 8B).

Inside the toner box 100, an agitator 140 to stir the toner in the toner box 100 is provided (see FIG. 3). The agitator 140 has a rotation shaft 141, a support 142, and a plurality of wings 143 (see also FIG. 5). The rotation shaft 141 is rotatably supported by the left and right side walls 101. The support 142 extends from the rotation shaft 141 radially, and the wings 143 being flexible sheets are fixed to the support 142.

The agitator 140 is rotated by driving force from a motor (not shown) transmitted to the rotation shaft 141. In the present embodiment, the agitator 140 is rotated in a counter clockwise direction as indicated by a curved arrow inside the toner box 100 in FIG. 3. As the agitator 140 rotates, free ends of the wings 143 sweep inner surfaces of the toner box 100, including an inner surface of the fitting wall 110, and the toner in the toner box 100 is stirred.

Figure 5:
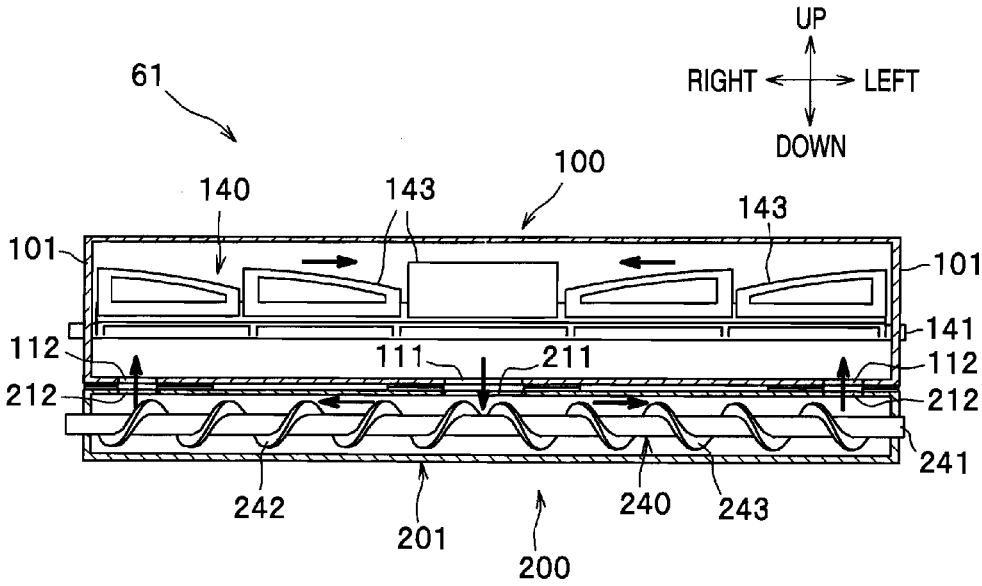
FIG. 5 illustrates a flow of the toner circulated in the developer unit according to the embodiment of the present invention.
Figure 6:
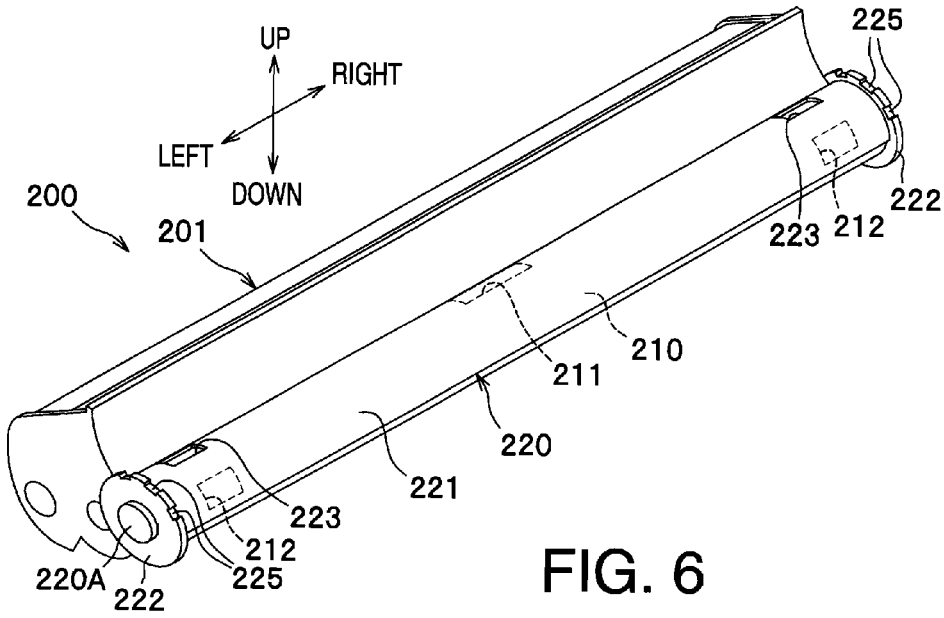
FIG. 6 is a perspective view of the developer device according to the embodiment of the present invention.

A shape and a number of the wings 143 are arbitrarily decided in consideration of efficiency to move the toner in the toner box 100 from the right and left end areas, in which the first collecting holes 112 are formed, toward the central area, in which the first feeding hole 111 is formed (see also FIG. 5). A configuration of such an agitator is known; therefore detailed explanation of that is herein omitted.

Next, the developer device 200 will be described. The developer device 200 includes a developer case 201 being a frame, and the developer roller 61C, the supplier roller 61D, and the spreader blade 61E inside the developer case 201. The developer device 200 further includes an auger 240.

The developer roller 61C carries the toner on a surface thereof and supplies the toner to an electrostatic latent image formed on the surface of the photosensitive drum 61A. The supplier roller 61D supplies the toner to the developer roller 61C and is arranged in a position closer to the front with respect to the developer roller 61C. The spreader blade 61E restricts thickness of the toner being carried on the surface of the developer roller 61C.

The spreader blade 61E is arranged in an upper position with respect to the developer roller 61C to be in contact with the developer roller 61C.

The developer case 201 includes a half-pipe wall 210, which is curved outward (toward the toner box 100) in an arc in cross-section to fit with the fitting wall 110 of the toner box 100 when the toner box 100 is installed in the developer unit 61. The half-pipe wall 210 is formed to surround a part of the auger 240 in a cross-sectional view and arranged in a position in proximity to the auger 240, which has a cross-sectional shape of a circle. More specifically, the half-pipe wall 210 surrounds a part of the auger 240, which includes at least a top section of the auger 240, Therefore, a plane P1, which extends in parallel with an upper edge (i.e., an edge closer to the toner box 100) of the half-pipe wall 210 in the cross-section, is lower than a plane P2, which extends in parallel with a top level of the auger 240 (see FIG. 7). In other words, the half-pipe wall 210 is arranged in a position in proximity to the auger 240 with a small amount of clearance, which allows the toner to flow therein, being reserved between the auger 240 and the inner surface thereof. Thus, the auger 240 is substantially surrounded by the half-pipe wall 210 to effectively convey the toner. The auger 240 is not surrounded by the half-pipe wall 210 at a part, which faces the developer roller 61D. Whilst the half-pipe wall 210 is formed in an arc to fit with the curvature of the fitting wall 110 by an outer surface thereof, the half-pipe wall 210 is curved to also center around the reference line BL, which coincides with the rotation axis C of the auger 240.

The half-pipe wall 210 is formed to have a second feeding hole 211 and second collecting holes 212. The second feeding hole is formed in a position to coincide with the first feeding hole 111 of the toner box 212, and the second collecting holes 212 are formed in positions to respectively coincide with the first collecting holes 112 of the toner box 100, when the toner box 100 is attached to the developer device 200. Further, a direction, in which the second feeding hole 211 is oriented, corresponds to the orientation of the first feeding hole 111 (i.e., the direction D1), and a direction, in which the second collecting holes 212 are oriented, corresponds to the orientation of the first collecting holes 112 (i.e., the direction D2). In other words, the first feeding hole 112 and the second feeding hole 212 are oriented in the same direction D1 to be in communication with each other whilst the first collecting holes 112 and the second collecting holes 212 are oriented in the same direction D2 to be in communication with each other.

The developer device 200 has a second shutter 220 (see FIG. 6), which is movable along curvature of an outer peripheral surface of the half-pipe wall 210 to cover and expose the second feeding hole 211 and the second collecting holes 212. The second shutter 220 includes a metal plate 221, which is formed to curve along the half-pipe wall 210, and a pair of rotary discs 222, which are fixed to right and left side edges of the metal plate 221.

The metal plate 221 is arranged in a position to vertically overlap the metal plate 121 of the first shutter 120 when the toner box 100 is attached to the developer device 200. In the metal plate 221, two openings 223 are formed in positions to correspond to the openings 123 of the first shutter 120.

When the second shutter 220 is in a closing position (see FIG. 7), the second feeding hole 211 and the second collecting holes 212 are covered with the metal plate 221. When the second shutter 220 is moved along the outer periphery of the half-pipe wall 210 to an opening position (see FIG. 3), the second feeding hole 211 is uncovered, and the openings 223 coincide with the second collecting holes 212. In this regard, when the first shutter 120 is also in the opening position, the second feeding hole 211 becomes in communication with the first feeding hole 111, and the second collecting holes 212 become in communication with the first collecting holes 112 through the openings 223 and the openings 123.

The rotary discs 222 (see FIG. 6) are arranged on the right and left sides of the developer case 201. The rotary discs 222 are supported by the developer case 201 to be rotatable about a rotation shaft 220A. The rotary disc 222 is formed to have dents 225, which are interlocked with the teeth 125 of the fist shutter 120 when the toner box 100 is attached to the developer device 200 (see FIG. 8).

Figure 8A:
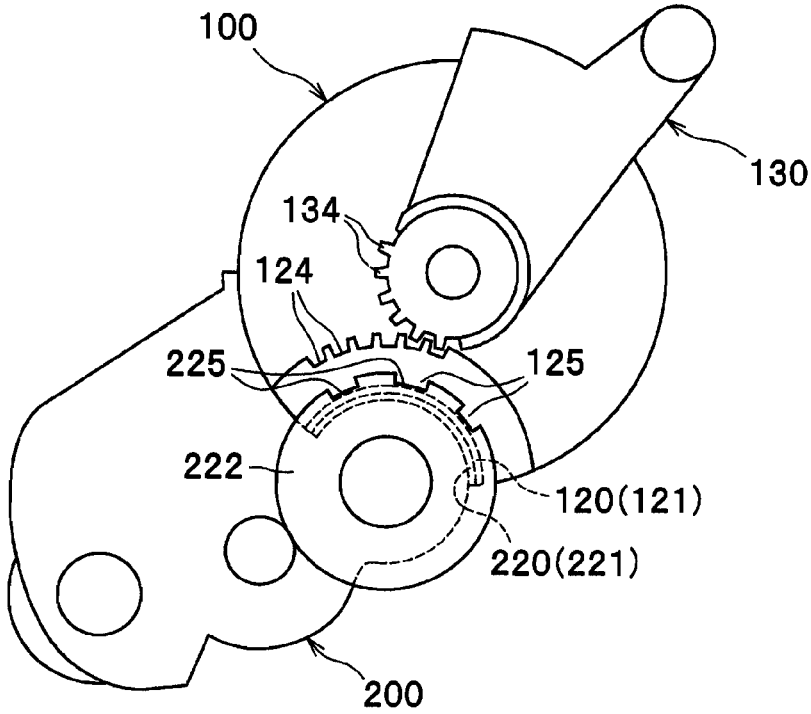
FIGS. 8A and 8B are schematic views to illustrate opening and closing movements of the first and second shutters of the developer unit according to the embodiment of the present invention.
Figure 8B:
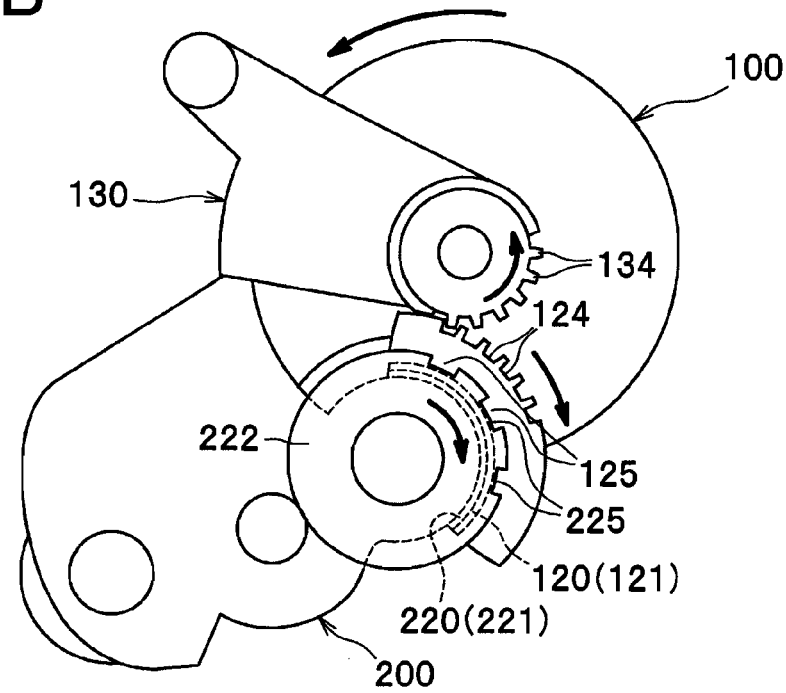

When the toner box 100 is installed in the developer unit 61 to be attached to the developer device 200, the teeth 125 provided to the first shutter 120 in the toner box 100 are interlocked with the dents 225 provided to the second shutter 220 in the developer device 200 (see FIG. 8A). In this regard, when the shutter handler 130 is manipulated to rotate about the rotation shaft 130A, for example, in the counterclockwise direction see FIG. 8B, the teeth 134 of the shutter handler 130 move the interlocking dents 124 of the first shutter 120 in the clockwise direction. Accordingly, the first shutter 120 is shifted to slide along the curvature of the fitting wall 110.

In this regard, the teeth 125 of the first shutter 120 moves the interlocking dents 225 of the second shutter 220 in the same direction (i.e., the clockwise direction in FIG. 8B), and the second shutter 120 is shifted to slide along the curvature of the half-pipe wall 210. Thus, the first shutter 120 and the second shutter 220 are moved collectively in cooperation with each other from the closing position to the opening position according to the movement of the shutter handler 130.

The auger 240 is a roller with a rotation shaft 241 and spirals 242, 243 to convey the toner fed through the second feeding hole 211 (and the first feeding hole 111) toward the second collecting holes 212 (and the first collecting holes 112). The auger 240 is arranged in an upper front position with respect to the supplier roller 61D (see FIG. 3). The rotation shaft 241 is rotatably supported by right and left side walls of the developer case 201, and the spirals 242, 243 twine around the rotation shaft 241.

The spirals 242, 243 are respectively arranged on a right side and a left side of the rotation shaft 241, which are divided at a lengthwise center of the rotation shaft 241 (see FIG. 5). The spirals 242, 243 twine in different directions from each other. Accordingly, the toner in the right side area in the developer device 200 is conveyed leftward by the spiral 242, and the toner in the left side area is conveyed rightward by the spiral 243.

In the present embodiment, as the cross-sectional side view thereof is shown in FIG. 3, the half-pipe wall 210, which separates the developer device 200 from the toner box 100 and faces the auger 240, is arranged in the vicinity of the auger 240 to partially surround the auger 240. In particular, the half-pipe wall 210 is arranged to be in proximity to the auger 240 whilst a small amount of clearance is maintained between outlines of the spirals 242, 243 of the auger 240 and the inner surface of the half-pipe wall 210 so that the auger 240 is allowed to rotate without being interfered with the inner surface of the half-pipe wall 210. With this arrangement, the auger 240 can convey the toner sideward efficiently in cooperation with the inner surface of the half-pipe wall 210.

According to the present embodiment, rotation axes of the developer roller 61C, the supplier roller 61D, and the auger 240 are aligned, in a side view (see FIG. 3), on a line perpendicular to the rotation shaft 241 of the auger 240. In particular, the supplier roller 61D is arranged in a position to have a rotation center (not shown) thereof to be on a line, which connects a rotation center (not shown) of the developer roller 61C and a rotation center C of the auger 240.

Next, circulation of the toner within the developer unit 61 will be described. The toner in the toner box 100 is supplied to the developer device 200 through the first feeding hole 111 and the second feeding hole 211, and a part of the toner in the developer device 200 is carried by the developer roller 61 and used in image forming.

Another part of the toner remaining in the developer device 200 is carried leftward and rightward by the auger 240 to be retrieved through the second collecting holes 212 and the first collecting holes 112 in the toner box 100. The retrieved toner in the toner box 100 is stirred by the agitator 140 and collected in the central area of the toner box 100 to be supplied to the developer device 200 again through the first feeding hole 111 and the second feeding hole 211.

In this regard, due to the communication between the first feeding hole 111 and the second feeding hole 211 along the direction D1 (see FIG. 3), which is inclined to be closer to the vertical direction DV than the inclination of the direction D2, the toner in the toner box 100 drops down effectively and smoothly in the developer device 200 by use of gravity.

Figure 9A:
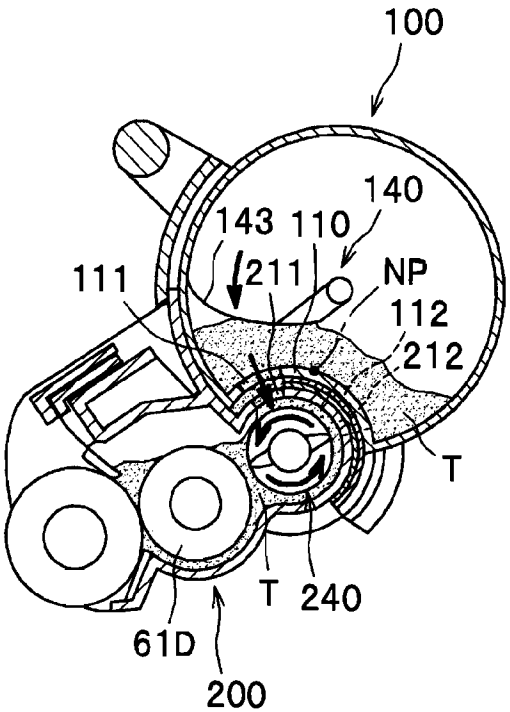
FIGS. 9A-9C illustrate the flow of the toner circulation in the developer unit according to the embodiment of the present invention.

As shown in FIG. 9A, the first feeding hole 111 is formed in the fitting wall 110 in the upper-stream position with respect to the nearest point NP in the rotating direction of the agitator 140. As the wings 143 rotate in the counterclockwise direction in FIG. 9A, the wings 143 moving closer to the first feeding hole 111 press the toner T staying in space between the first feeding hole 111 and the wings 143 downward so that the toner T drops down in the developer device 200. Thus, the toner T is supplied from the toner box 100 to the developer device 200 smoothly.

Figure 9B:
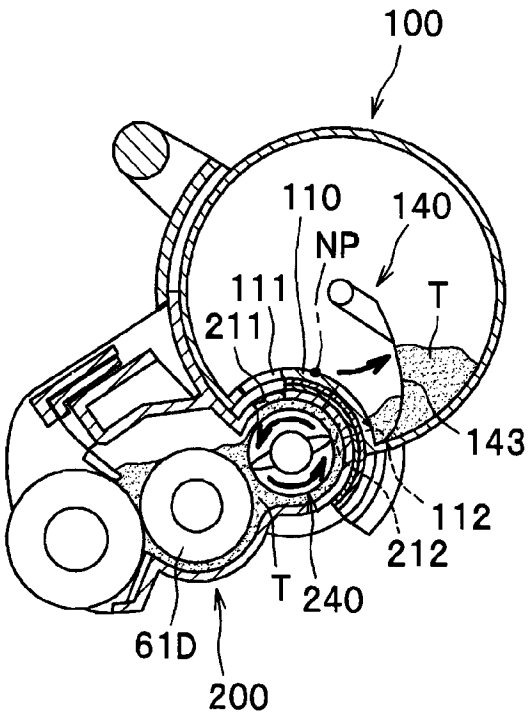

Further, as shown in FIG. 9B, the first collecting holes 112 are formed in the fitting wall 110 in the lower-stream position with respect to the nearest point NP in the rotating direction of the agitator 140. As the wings 143 rotate in the counterclockwise direction in FIG. 11B, the wings 143 moving further away from the first collecting holes 112 sweep away the toner T staying in areas in vicinities of the first collecting holes 112. Thus, the areas in the vicinities of the first collecting holes 112 are cleared so that following toner T from the developer device 200 can be moved in the cleared areas.

Figure 9C:
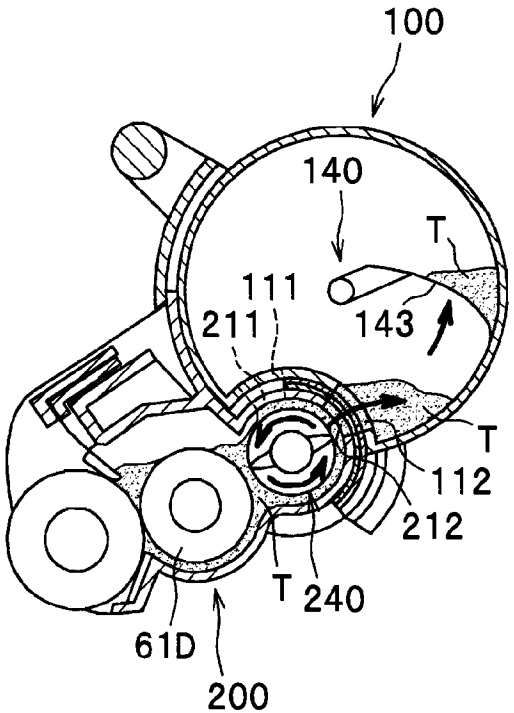

The toner supplied to the developer device 200 is carried leftward and rightward by the auger 240 (see FIG. 5) and accumulate in vicinities of left and right side ends of the auger 240 by pressure of the auger 240. The densely accumulated toner T (see FIG. 9C) is pushed out of the developer device 200 through the second collecting holes 212 by the following toner T, which is carried by the auger 240 to the vicinities of the left and right side ends of the auger 240. Thus, the toner T is retrieved in the toner box 100.

In this regard, due to the communication between the first collecting holes 112 and the second collecting holes 212 nearly along the horizontal direction DH, the toner T in the developer device 200 can be moved smoothly to be retrieved in the toner box 100. When the toner T is pressed through the first collecting holes 112, because the areas in the vicinities of the first collecting holes 112 are cleared by the rotation of the wings 143, the toner T can be smoothly accepted to be retrieved in the toner box 100.

According to the above configuration of the developer unit 61, in which the toner box 100 is arranged in the upper and adjoining position with respect to the developer device 200, the toner can be smoothly circulated and agitated to be homogenized.

As has been described above, according to the present embodiment, the fitting wall 110 and the half-pipe wall 210 are formed to surround the auger 240 in adjoining positions to have a small amount of clearance between the half-pipe wall 210 and the auger 240. Therefore, a large part of toner supplied to the developer device 200 can be efficiently conveyed by the auger 240 sideward, and a smaller but substantial amount of the toner is supplied to the supplier roller 61D, which is arranged on a rear side with respect to the auger 240. Thus, an amount of the toner to be supplied to the supplier roller 16D can be effectively restricted. Accordingly, pressure of the toner in the developer device 200 can be prevented from being excessively increased.

Specifically, in the present embodiment, the half-pipe wall 210 is curved in an arc to center around the reference line BL, which extends in parallel with the axial direction of the rotation shaft 241 of the auger 240. In other words, the half-pipe wall 210 is curved to fit with the outline of the auger 240 whilst the small amount of clearance is reserved between the inner surface of the half-pipe wall 210 and the auger 240. Accordingly, the auger 240 can convey the toner efficiently, and excessive increase of pressure of the toner remaining in the developer device 200, specifically in an area surrounding the spreader blade 61E, can be prevented.

When the pressure of the remaining toner is controlled, excessive pressure to the developer roller 61C and the supplier roller 61D can be prevented, and leakage of the toner from the clearance between the developer roller 61C and the spreader blade 61C can be prevented. Further, intervention of an obstacle being caught between the developer roller 61C and the spreader blade 61E can be prevented.

Additionally to the above configuration, the auger 240 (specifically, the rotation shaft 241) may be provided with guiding wings in positions opposite from the first and second collecting holes 112, 212 to guide the toner to the toner box 101 more smoothly.

It is to be noted, in the developer unit 61, that the first feeding hole 111 and the first collecting holes 112 are formed in laterally (in the right-left direction) displaced positions. Meanwhile, the developer device 200 is equipped with the auger 240, which moves the toner supplied through the first and second feeding holes 111, 211 leftward and rightward to be retrieved back in the toner box 100 through the first and second collecting holes 112, 212. Therefore, fluidity of the toner between the toner box 100 and the developer device 200 is improved to be better than fluidity of toner in a toner box and a developer device with the first feeding hole 111 and the first collecting holes 112 being formed in laterally coinciding positions.

In the above embodiment, the toner box 100 is equipped with the first shutter 120 to cover and uncover the first feeding hole 111 and the first collecting holes 112 so that leakage of the toner out of the toner box 100 is prevented when the toner box 100 is not attached to the developer device 200. Further, the first feeding hole 111 and the first collecting holes 112 are collectively covered or uncovered by the single opening/closing movement of the first shutter 120.

In the above embodiment, the first shutter 120 and the second shutter 220 are formed in arcs; therefore, rigidity of the metal plates 121, 221 can be maintained even when the metal plates 121, 221 are formed in thin plates. Further, when the arc-formed shutters 120, 220 are rotated, smaller amounts of twist-deformation can be expected in the arc-formed shutters 120, 220 compared to an amount of deformation which can be caused in slidable plane shutters. In other words, smooth and stable movement of the first shutter 120 and the second shutter 200 can be maintained.

Although an example of carrying out the invention has been described, those skilled in the art will appreciate that there are numerous variations and permutations of the developer unit that fall within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the shape of the fitting wall 110 and the half-pipe wall 210 are not limited to an arc in cross-section, but may be in a different shape as long as the walls are formed and arranged to fit around the auger 240.

For another example, the first feeding hole 111 and the first collecting holes 112 may not necessarily be formed in laterally (in the right-left direction, which is the axial direction of the rotation shaft 241 of the agitator 240), but may be formed in same positions in the right-left direction, For another example, the directions D1 and D2, in which the first and second feeding holes 111, 211 and the first and second collecting holes 112, 212 are respectively oriented, may not necessarily be limited as described in the above embodiment and described in the drawings. The first and second feeding holes 111, 211 may be oriented in the vertical direction, and/or the first and second collecting holes 112, 212 may be oriented in the horizontal direction.

Further, a number, sizes, and shapes of the first feeding holes 111 and the first collecting holes 112 are not limited to those described in the above embodiment. For example, a single first feeding hole may be formed in a position corresponding to one axial end of the auger 240, and a single collecting hole may be formed in a position corresponding to the other axial end of the auger 240.

Furthermore, the auger 240 to carry the toner sideward may be replaced with, for example, a coil spring. According to the present invention, a trajectory of the coil spring includes a region inside the coils.

Figure 10:
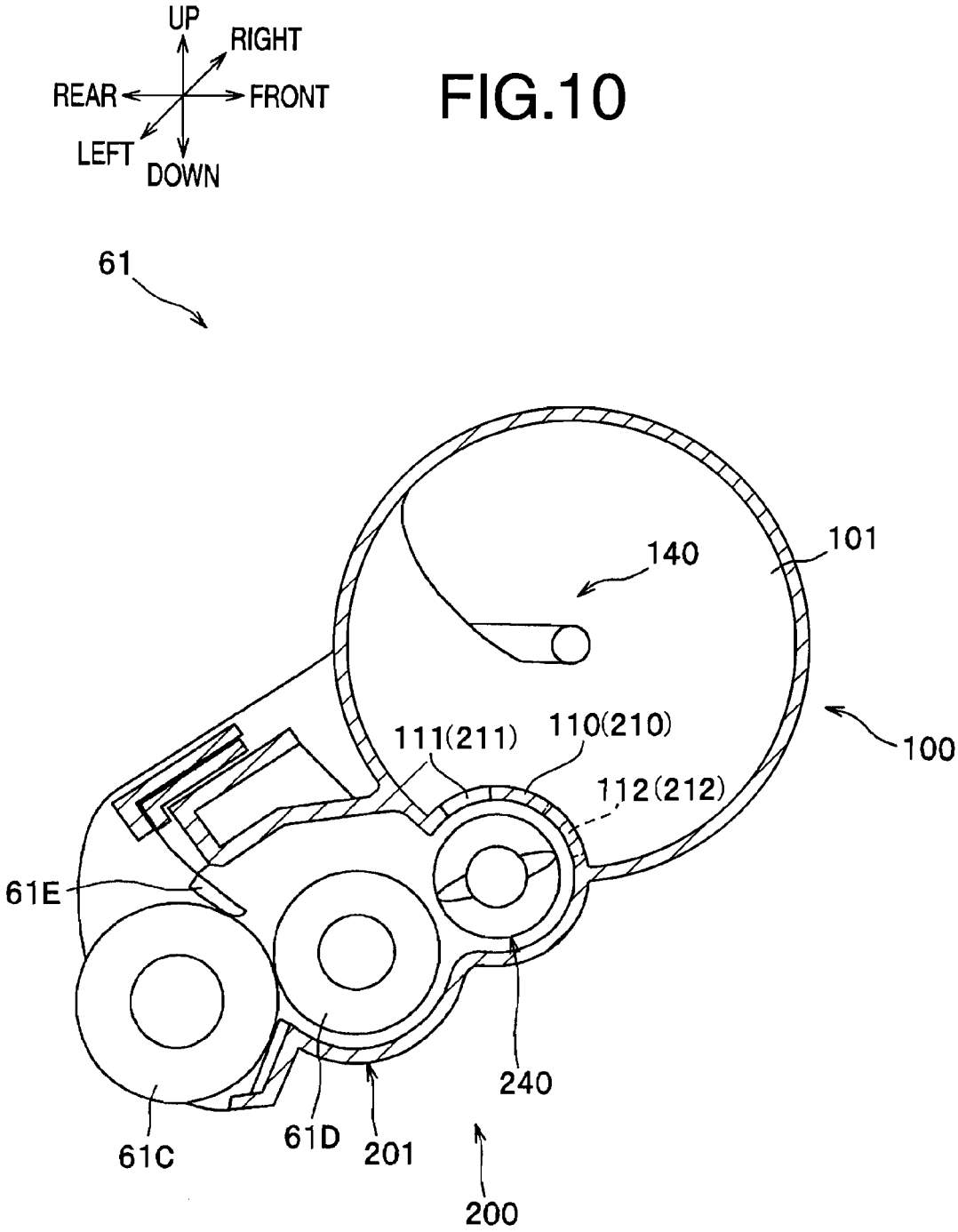
FIG. 10 is a cross-sectional side view of an integrally-formed developer unit according to an embodiment of the present invention with the toner box and the developer device undetachably fixed to each other.

In the above embodiment, the developer unit 61 with the toner box 100 detachable from the developer device 200 is described. However, a developer unit 61 having a toner container undetachably fixed to the developer device may be provided (see FIG. 10). When a toner container is undetachably fixed to the developer device, one of the fitting wall 110 (and the first shutter 120) and the half-pipe wall 210 (and the second shutter 210) can be omitted.

Furthermore, the sheet P to have an image formed thereon may be, for example, an OHP sheet.

In the above embodiment, the MFP 1 being an image forming apparatus having the developer unit according to the present invention is described. However, the image forming apparatus may be, for example, a copier and a printer. Furthermore, the number of the developer unit 61 is not limited to four, but may be, for example, one.

What is claimed is:

1. A developer unit for an image forming apparatus to form an image on a recording sheet, comprising:

a developer device having a developer agent carrier, which carries a developer agent on a surface thereof, and a developer agent supplier, which supplies the developer agent to the developer agent carrier;

a developer agent container, which contains the developer agent to be supplied to the developer device and is arranged in an upper position with respect to the developer device; and a curved wall that is configured to separate the developer device, which is disposed downward from the curved wall, from the developer agent container, which is disposed upward from the curved wall; the curved wall being curved toward the developer agent container and formed to have a feeding opening, through which the developer agent from the developer agent container is supplied to the developer device, and a collecting opening, through which the developer agent in the developer device is retrieved in the developer agent container; and a conveyer, which is arranged along the developer agent supplier and rotated about a rotation axis to convey the developer agent supplied to the developer device through the feeding opening toward the collecting opening, wherein the curved wall is arranged to be in proximity to the conveyer and to fit with outlines of the conveyer.

2. The developer unit according to claim 1, wherein the curved wall is formed in an arc in cross-section to center around a reference line, which extends in parallel with the rotation axis of the conveyer.

3. The developer unit according to claim 2, wherein the reference line is included inside a rotation trajectory of the conveyer.

4. The developer unit according to claim 2, wherein the reference line coincides with the rotation axis of the conveyer.

5. The developer unit according to claim 1, wherein the feeding opening and the collecting opening are in positions displaced from each other with respect to a direction of the rotation axis of the conveyer.

6. The developer unit according to claim 1, wherein a first angle between a direction, in which the collecting opening is oriented, and a vertical direction is larger than a second angle between a direction, in which the feeding opening is oriented, and the vertical direction.

7. The developer unit according to claim 1, wherein rotation centers of the developer agent carrier, the developer agent supplier, and the conveyer are aligned on a line, which is perpendicular to the rotation axis of the conveyer.

8. The developer unit according to claim 1, wherein a first plane, which extends in parallel with an edge of the curved wall being closer to the developer agent container, is lower than a second plane, which extends in parallel with a top level of the conveyer.

9. The developer unit according to claim 1, wherein a portion of the developer agent container is disposed above a portion of the developer device.

10. A developer unit for an image forming apparatus to form an image on a recording sheet, comprising:

a developer device having a developer agent carrier, which carries a developer agent on a surface thereof, and a developer agent supplier, which supplies the developer agent to the developer agent carrier;

a developer agent container, which contains the developer agent to be supplied to the developer device and is arranged in an upper position with respect to the developer device; and a curved wall, which: separates the developer device from the developer agent container; is curved toward the developer agent container; and is formed to have a feeding opening, through which the developer agent from the developer agent container is supplied to the developer device, and a collecting opening, through which the developer agent in the developer device is retrieved in the developer agent container; and a conveyer, which is arranged along the developer agent supplier and rotated about a rotation axis to convey the developer agent supplied to the developer device through the feeding opening toward the collecting opening, wherein the curved wall is arranged to be in proximity to the conveyer and to fit with outlines of the conveyer;

wherein the curved wall is formed in an arc in cross-section to center around a reference line, which extends in parallel with the rotation axis of the conveyer;

wherein the developer agent container is detachable from the developer device;

wherein the curved wall is provided to the developer device;

wherein the developer agent container is formed to have a fitting wall, which is formed separately from the curved wall, at a position to be adjacent to and to fit with the curved wall of the developer device, the fitting wall being curved inward in an arc in cross-section to center around the reference line, which extends in parallel with the rotation axis of the conveyer;

wherein the fitting wall is formed to have a container-side feeding opening, which is communicated with the feeding opening of the curved wall to supply the developer agent in the developer agent container to the developer device, and a container-side collecting opening, which is communicated with the collecting opening of the curved wall to retrieve the developer agent from the developer device;

wherein the developer agent container is provided with a shutter, which is movable along curvature of the fitting wall to cover and expose the container-side feeding opening and the container-side collecting opening formed in the fitting wall.

11. The developer unit according to claim 10, wherein the developer device is provided with a shutter, which is movable along curvature of the arc wall to cover and expose the developer-side feeding opening and the developer-side collecting opening; and wherein the shutter of the developer device is movable along with the shutter of the developer agent container.

12. The developer unit according to claim 10, wherein the developer agent container includes an agitator, which is rotated to sweep an inner surface of the fitting wall and stir the developer agent in the developer agent container;

wherein the container-side feeding opening is formed in an upper-stream position with respect to a nearest point to a rotation axis of the agitator in a rotating direction of the agitator; and wherein the container-side collecting opening is formed in a lower-stream position with respect to the nearest point in the rotating direction of the agitator.

* * * * *